US009113268B2

(12) United States Patent
Ball et al.

(10) Patent No.: US 9,113,268 B2
(45) **Date of Patent: *Aug. 18, 2015**

(54) IMPLANTABLE FLOATING MASS TRANSDUCER OF A HEARING IMPLANT SYSTEM

(71) Applicant: Vibrant Med-El Hearing Technology GmbH, Innsbruck (AT)

(72) Inventors: Geoffrey R. Ball, Axams (AT); Erwin Hochmair, Axams (AT)

(73) Assignee: Vibrant Med-El Hearing Technology GmbH, Innsbruck (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/264,302

(22) Filed: Apr. 29, 2014

(65) Prior Publication Data

US 2014/0321681 A1 Oct. 30, 2014

Related U.S. Application Data

(60) Provisional application No. 61/817,473, filed on Apr. 30, 2013.

(51) Int. Cl.
*H04R 25/00* (2006.01)

(52) U.S. Cl.
CPC ..... *H04R 25/00* (2013.01); *H04R 25/606* (2013.01); *H04R 2225/49* (2013.01); *H04R 2225/67* (2013.01); *H04R 2400/07* (2013.01)

(58) Field of Classification Search
CPC ..... H04R 1/02; H04R 1/021; H04R 11/00; H04R 11/02; H04R 25/02; H04R 25/60; H04R 25/604; H04R 25/606; H04R 25/608; H04R 2209/022; H04R 2209/024; H04R 2225/023; H04R 2225/49; H04R 2225/67; H04R 2400/07
USPC ..... 381/23.1, 312, 322, 324, 326, 328, 151, 381/162, 386, 395, 189, 396, 414, 417, 418, 381/420, 421, 422; 181/126, 128, 129, 130; 600/25

See application file for complete search history.

(56) References Cited

U.S. PATENT DOCUMENTS 5,624,376 A * 4/1997 Ball et al. ..... 600/25
5,795,287 A * 8/1998 Ball et al. ..... 600/25

(Continued)

OTHER PUBLICATIONS

International Searching Authority, International Search Report and Written Opinion, PCT/US14/35807, date of mailing Oct. 1, 2014, 17 pages.

*Primary Examiner* — Curtis Kuntz
*Assistant Examiner* — Joshua A Kaufman
(74) *Attorney, Agent, or Firm* — Sunstein Kann Murphy & Timbers LLP

(57) ABSTRACT

An implantable floating mass transducer is described for a hearing implant system in an implant patient. A cylindrical transducer housing contains a cylindrical inner mass magnet having an inner magnetic field with a first field direction. One or more signal drive coils are on the outer housing surface for conducting a transducer drive signal current to produce a signal magnetic field that interacts with the inner magnetic field to create vibration of the inner mass magnet which is coupled by the transducer housing to the internal hearing structure for sound perception by the implant patient. A ring-shape outer offset magnet is positioned around the outer housing surface with an outer magnetic field having a second field direction opposite to the first field direction so as to offset the inner magnetic field to minimize their combined magnetic field and thereby minimize magnetic interaction of the transducer with any external magnetic field.

10 Claims, 6 Drawing Sheets

(56) References Cited

U.S. PATENT DOCUMENTS

| | | | | |
|---|---|---|---|---|
| 5,800,336 | A * | 9/1998 | Ball et al. | 600/25 |
| 6,190,305 | B1 * | 2/2001 | Ball et al. | 600/25 |
| 6,217,508 | B1 * | 4/2001 | Ball et al. | 600/25 |
| 6,411,849 | B1 * | 6/2002 | Shankar et al. | 607/19 |
| 6,735,318 | B2 * | 5/2004 | Cho | 381/326 |
| 6,940,989 | B1 * | 9/2005 | Shennib et al. | 381/326 |
| 8,216,123 | B2 * | 7/2012 | Cho et al. | 600/25 |
| 8,744,106 | B2 * | 6/2014 | Ball | 381/326 |
| 2003/0060676 | A1 * | 3/2003 | Ball et al. | 600/25 |
| 2008/0255406 | A1 * | 10/2008 | Ball et al. | 600/25 |
| 2009/0134721 | A1 * | 5/2009 | Zimmerling | 310/15 |
| 2009/0253951 | A1 * | 10/2009 | Ball et al. | 600/25 |
| 2010/0048983 | A1 * | 2/2010 | Ball et al. | 600/25 |
| 2010/0145135 | A1 * | 6/2010 | Ball et al. | 600/25 |
| 2011/0022120 | A1 * | 1/2011 | Ball et al. | 607/57 |
| 2011/0105829 | A1 * | 5/2011 | Ball | 600/25 |
| 2011/0255731 | A1 * | 10/2011 | Ball | 381/396 |
| 2011/0255732 | A1 * | 10/2011 | Kwon et al. | 381/396 |
| 2012/0029267 | A1 * | 2/2012 | Ball | 600/25 |
| 2012/0219166 | A1 | 8/2012 | Ball | 381/322 |
| 2013/0035540 | A1 * | 2/2013 | Ball | 600/25 |
| 2013/0165738 | A1 * | 6/2013 | Ball et al. | 600/25 |
| 2014/0012069 | A1 * | 1/2014 | Ball | 600/25 |
| 2014/0321681 | A1 * | 10/2014 | Ball et al. | 381/312 |

* cited by examiner

IMPLANTABLE FLOATING MASS TRANSDUCER OF A HEARING IMPLANT SYSTEM

This application claims priority from U.S. Provisional Patent Application 61/817,473, filed Apr. 30, 2013, which is incorporated herein by reference.

TECHNICAL FIELD

The present invention relates to a hearing implant, and more specifically to fitting a middle ear implant to an implanted patient.

A normal ear transmits sounds as shown in FIG. 1 through the outer ear 101 to the tympanic membrane (eardrum) 102, which moves the ossicles of the middle ear 103 (malleus, incus, and stapes) that vibrate the cochlea 104. The cochlea 104 is a long narrow organ wound spirally about its axis for approximately two and a half turns. It includes an upper channel known as the scala vestibuli and a lower channel known as the scala tympani, which are connected by the cochlear duct. The cochlea 104 forms an upright spiraling cone with a center called the modiolar where the spiral ganglion cells of the acoustic nerve 113 reside. In response to received sounds transmitted by the middle ear 103, the fluid-filled cochlea 104 functions as a transducer to generate electric pulses which are transmitted to the cochlear nerve 113, and ultimately to the brain.

Hearing is impaired when there are problems in the ear's ability to transduce external sounds into meaningful action potentials along the neural substrate of the cochlea 104. To improve impaired hearing, various types of hearing prostheses have been developed. For example, when a hearing impairment is related to the operation of the middle ear 103, a conventional hearing aid, a bone conduction implant, or a middle ear implant (MEI) device may be used to provide acoustic-mechanical vibration to the auditory system.

FIG. 1 also shows some components in a typical MEI arrangement where an external audio processor 111 processes ambient sounds to produce an implant communications signal that is transmitted through the skin by transmission coil 107 to an implanted receiver 108. Receiver 108 includes a receiver coil that transcutaneously receives signals the implant communications signal which is then demodulated into a transducer stimulation signals which is sent over leads 109 through a surgically created channel in the temporal bone to a floating mass transducer (FMT) 110 secured to the incus bone in the middle ear 103. The transducer stimulation signals cause drive coils within the FMT 110 to generate varying magnetic fields which in turn vibrate a magnetic mass suspended within the FMT 110. The vibration of the inertial mass of the magnet within the FMT 110 creates vibration of the housing of the FMT 110 relative to the magnet. This vibration of the FMT 110 is coupled to the incus in the middle ear 103 and then to the cochlea 104 and is perceived by the user as sound. See U.S. Pat. No. 6,190,305, which is incorporated herein by reference.

U.S. Patent Publication 20070191673 (incorporated herein by reference) described another type of implantable hearing prosthesis system which uses bone conduction to deliver an audio signal to the cochlea for sound perception in persons with conductive or mixed conductive/sensorineural hearing loss. An implanted floating mass transducer (FMT) is affixed to the temporal bone. In response to an externally generated electrical audio signal, the FMT couples a mechanical stimulation signal to the temporal bone for delivery by bone conduction to the cochlea for perception as a sound signal. A certain amount of electronic circuitry must also be implanted with the FMT to provide power to the implanted device and at least some signal processing which is needed for converting the external electrical signal into the mechanical stimulation signal and mechanically driving the FMT.

One problem with implantable hearing prosthesis systems arises when the patient undergoes Magnetic Resonance Imaging (MRI) examination. Interactions occur between the implant magnet and the applied external magnetic field for the MRI. The external magnetic field from the MRI may create a torque on the implant magnet, which may displace the magnet or the whole implant housing out of proper position and/or may damage the adjacent tissue in the patient. The implant magnet may also cause imaging artifacts in the MRI image, there may be induced voltages in the receiving coil, and hearing artifacts due to the interaction of the external magnetic field of the MRI with the implanted device.

Thus, for existing implant systems with magnet arrangements, it is common to either not permit MRI or at most limit use of MRI to lower field strengths. Other existing solutions include use of a surgically removable magnets, spherical implant magnets (e.g. U.S. Pat. No. 7,566,296), and various ring magnet designs (e.g., U.S. Provisional Patent 61/227,632, filed Jul. 22, 2009). Among those solutions that do not require surgery to remove the magnet, the spherical magnet design may be the most convenient and safest option for MRI investigations even at very high field strengths. But the spherical magnet arrangement requires a relatively large magnet much larger than the thickness of the other components of the implant, thereby increasing the volume occupied by the implant. This in turn can create its own problems. For example, some systems, such as cochlear implants, are implanted between the skin and underlying bone. The "spherical bump" of the magnet housing therefore requires preparing a recess into the underlying bone. This is an additional step during implantation in such applications which can be very challenging or even impossible in case of very young children.

U.S. Patent Publication 20120029267 (incorporated herein by reference) described an implantable hearing prosthesis two planar implant magnets connected by a flexible connector member which are fixable to underlying skull bone. Each of the implant magnets was in the specific form of a center disk having magnetic polarity in one axial direction. Around the disk magnet was another ring magnet having an opposite magnetic polarity in a different direction. This ring/disk magnet arrangement had less magnetic interaction with an external magnetic field such as an MRI field.

SUMMARY

Embodiments of the present invention are directed to an implantable floating mass transducer for a hearing implant system in an implant patient. A cylindrical transducer housing contains a cylindrical inner mass magnet having an inner magnetic field with a first field direction. One or more signal drive coils are on the outer housing surface for conducting a transducer drive signal current to produce a signal magnetic field that interacts with the inner magnetic field to create vibration of the inner mass magnet which is coupled by the transducer housing to the internal hearing structure for sound perception by the implant patient. A ring-shape outer offset magnet is positioned around the outer housing surface with an outer magnetic field having a second field direction opposite to the first field direction so as to offset the inner magnetic field to minimize their combined magnetic field and thereby minimize magnetic interaction of the transducer with any external magnetic field.

Specific embodiments may also include an inner magnet spring such as a spring plate connected to each cylindrical end of the inner mass magnet suspending the inner mass magnet within the interior volume of the transducer housing. There may be outer springs suspending the outer offset magnet around the outer housing surface and/or anti-torque springs connecting the inner mass magnet to the transducer housing. There may be a signal drive coil on the outer housing surface over each cylindrical end of the inner mass magnet. The inner mass magnet and/or the outer offset magnet may include a pair of cylindrical magnets of opposite magnetic polarity positioned end to end. And there may be an outer transducer cover around the outside of the transducer.

The hearing implant system may be a middle ear implant system, a round window implant system, or a bone conduction implant system.

DETAILED DESCRIPTION

Various embodiments of the present invention are directed to an implantable floating mass transducer arrangement for a hearing implant system in an implant patient which has a reduced overall magnetic field so as to be suitable for undergoing MRI examination. An outer ring-shaped offset magnet surrounds a conventional FMT, and the magnetic moments of the inner FMT magnet and the outer offset magnet are substantially the same magnitude but in opposite directions.

Figure 1:
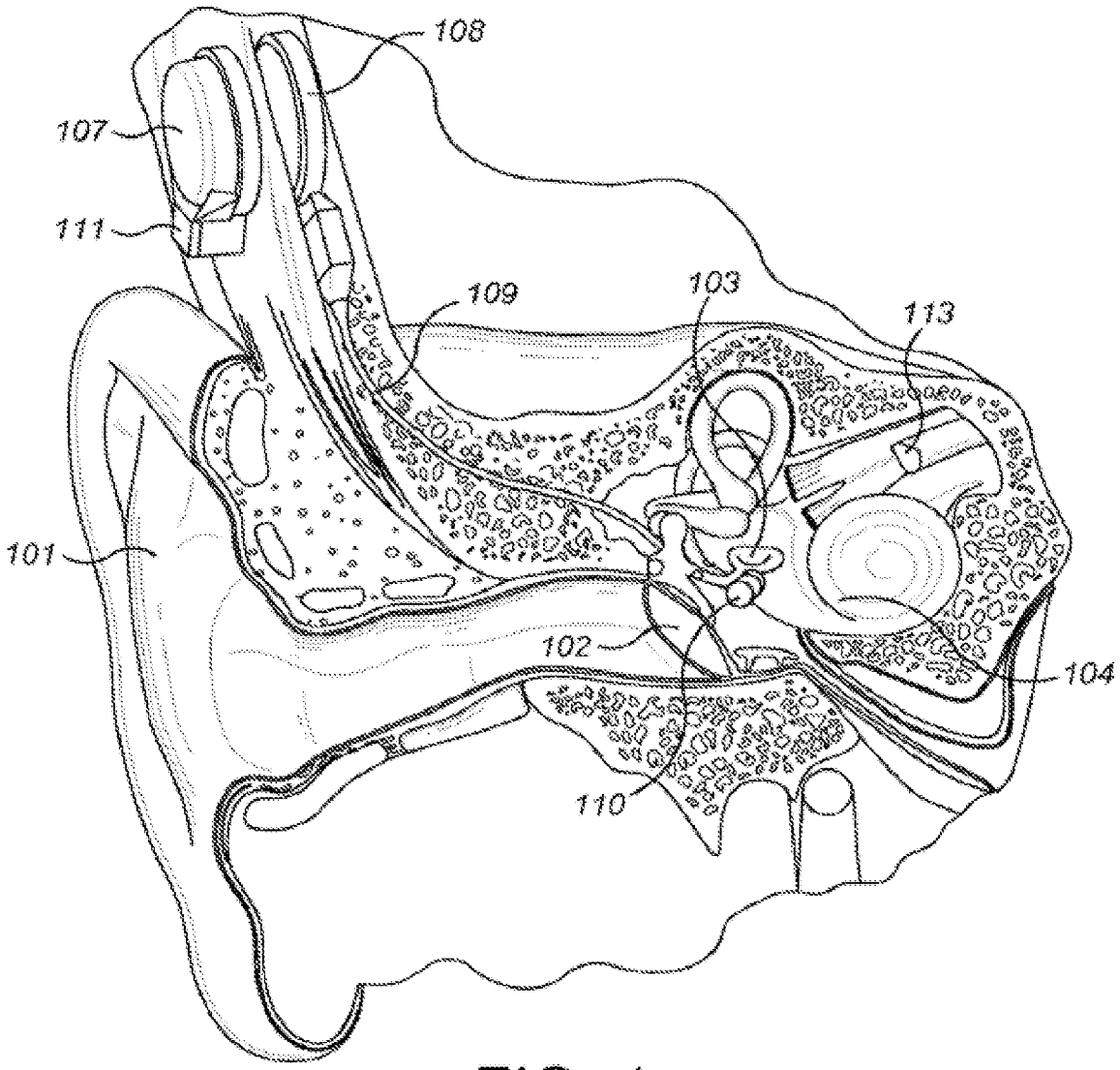
FIG. 1 shows various anatomical structures in a human ear containing a middle ear implant device.
Figure 2:
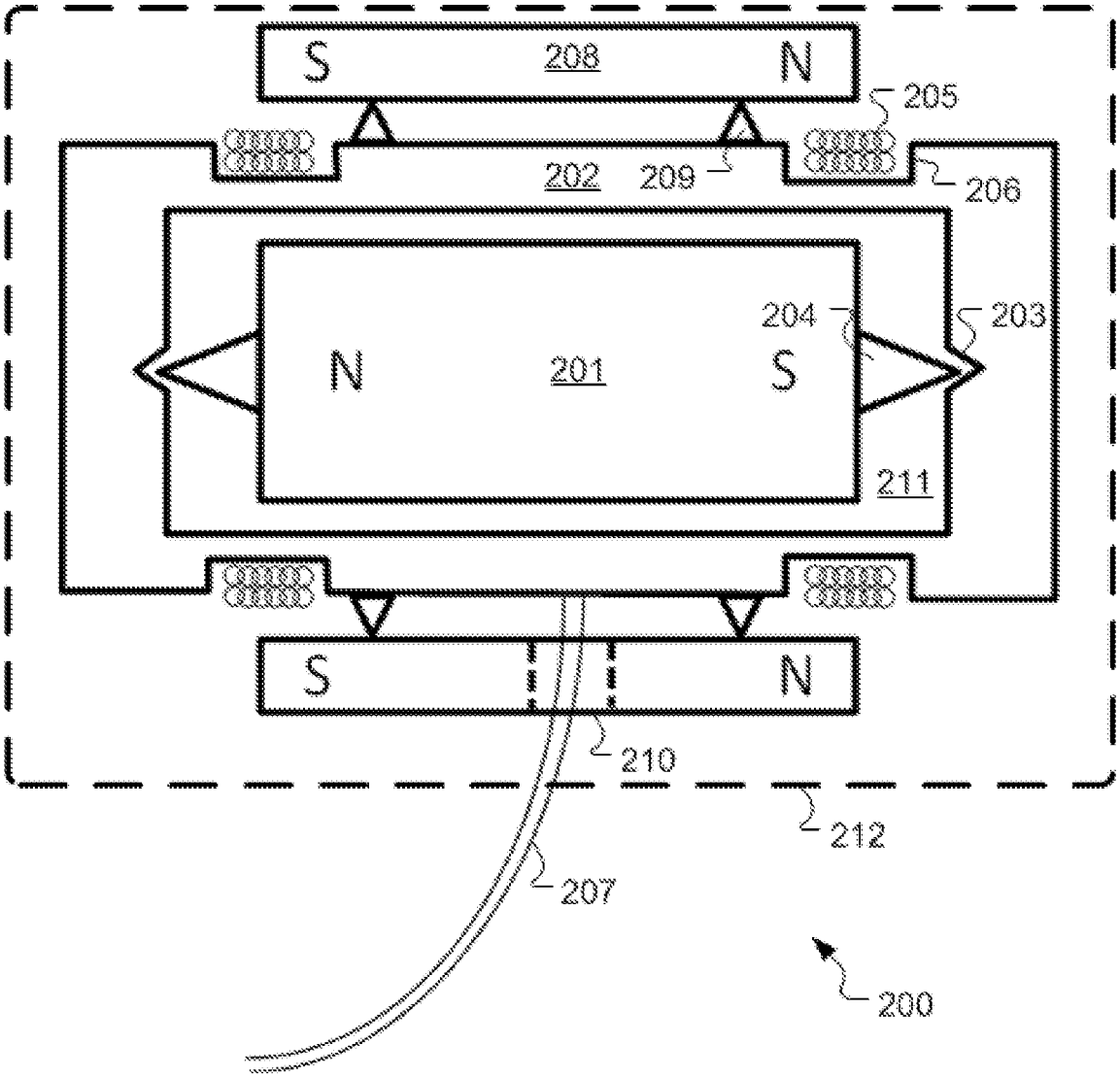
FIG. 2 shows a cross sectional view of an implantable floating mass transducer according to an embodiment of the present invention.

FIG. 2 shows a cross sectional view of an implantable floating mass transducer 200 according to an embodiment of the present invention. Within a cylindrical transducer housing 202 is a cylindrical inner mass magnet 201 having an inner magnetic field with a first field direction, here in FIG. 2, with the North magnetic pole on the left and the South magnetic pole on the right. A resilient magnet spring 204 (e.g., of silicone or titanium) at each cylindrical end of the inner mass magnet 201 fit into a corresponding spring recess 203 within the interior volume 211 of the transducer housing 202 to resiliently suspend the inner mass magnet 201 within the interior volume 211. Also towards each cylindrical end of the inner mass magnet 201, the outer surface of the transducer housing 202 is a coil slot 206 containing a signal drive coil 205 for conducting a transducer drive signal current.

A ring-shape outer offset magnet 208 is suspended on one or more resilient outer springs 209 (e.g., of silicone or titanium) around the outer surface of the implant housing 202. The outer offset magnet 208 include a lead opening 210 through which pass one or more signal leads 207 to deliver the drive signal to the drive coils 205. The magnetic field of the outer offset magnet 208 has a second field direction opposite to the first field direction of the inner mass magnet 201. Here in FIG. 2 the outer magnetic field of the outer offset magnet 208 is oriented with the North magnetic pole on the right and the South magnetic pole on the left. This magnetic field arrangement of the outer offset magnet 208 offsets the inner magnetic field of the inner mass magnet 201 to minimize their combined magnetic field and thereby minimize magnetic interaction of the transducer 200 with any external magnetic field such as an MRI field. Enclosing the entire transducer 200 is a transducer housing 212 of biocompatible material.

Figure 3:
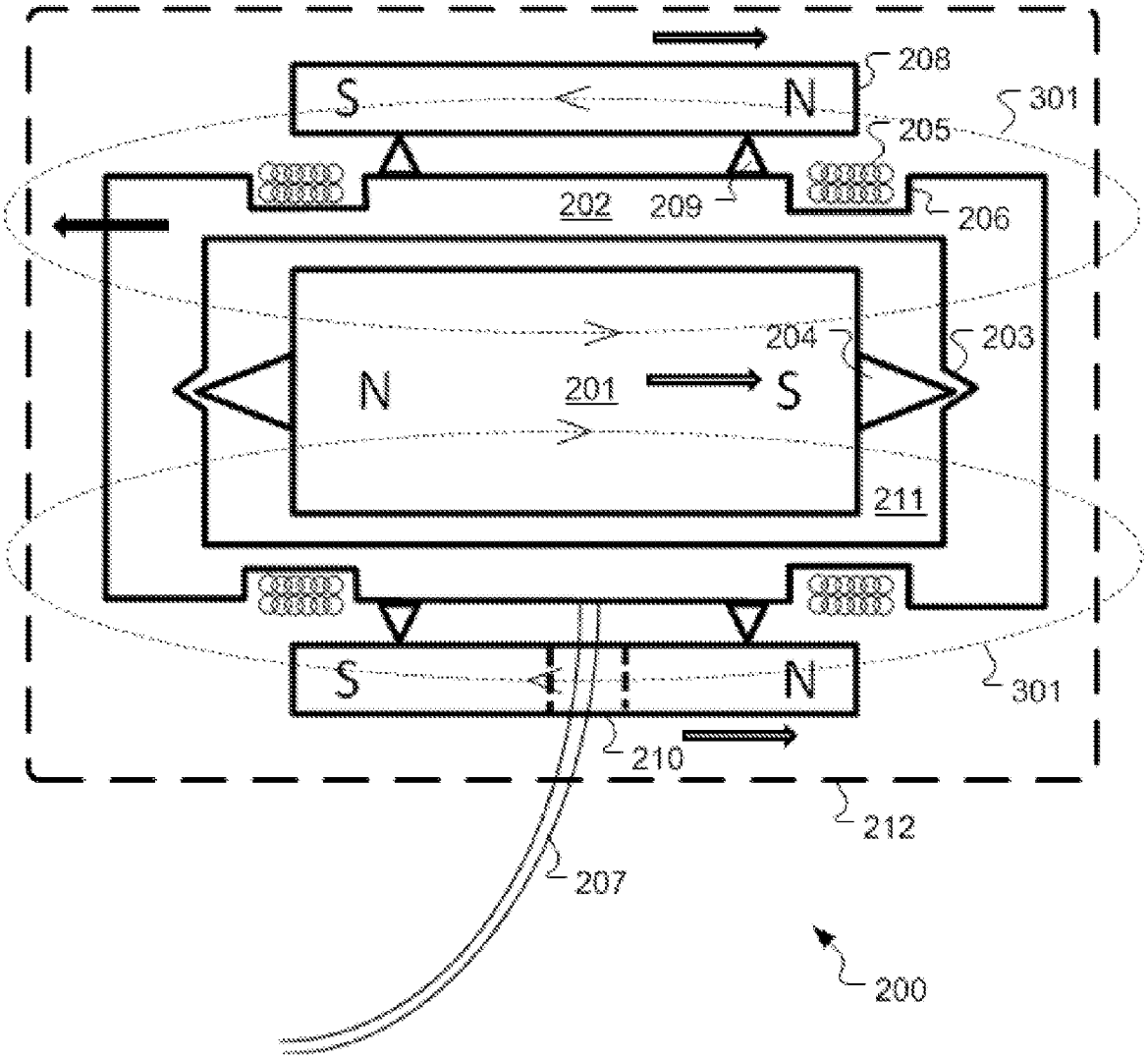
FIG. 3 shows the magnetic field interaction in a transducer according to FIG. 2.

As shown in FIG. 3, the opposing magnetic fields of the inner mass magnet 201 and the outer offset magnet 208 interact with the magnetic field 301 of the coil drive signal current to causes vibration of the inner mass magnet 201 and the outer offset magnet 208 in the same direction which is inertially coupled in the opposite direction by the transducer housing 202 to an attached internal hearing structure for sound perception by the implant patient. For example, in a middle ear implant system arrangement (e.g., a Vibrant SoundBridge™ middle ear implant system) the transducer housing 202 may be coupled to one of the ossicles of the middle ear. Or in a round window drive system, the transducer housing 202 may be attached against the round window membrane on the outer surface of the cochlea. Or an embodiment may be implemented in a bone conduction-based hearing implant system (e.g., a Vibrant BoneBridge™ bone conduction implant) where the transducer housing 202 attaches to the skull bone or promontorium of the implant patient. Or an embodiment may be used in an electric-mechanical stimulation (EMS) system such as shown in U.S. Pat. No. 8,285,384. Embodiments may also be advantageous in a mechanical vestibular stimulation system such as described in U.S. Patent Publication 2007/0027405.

Figure 4:
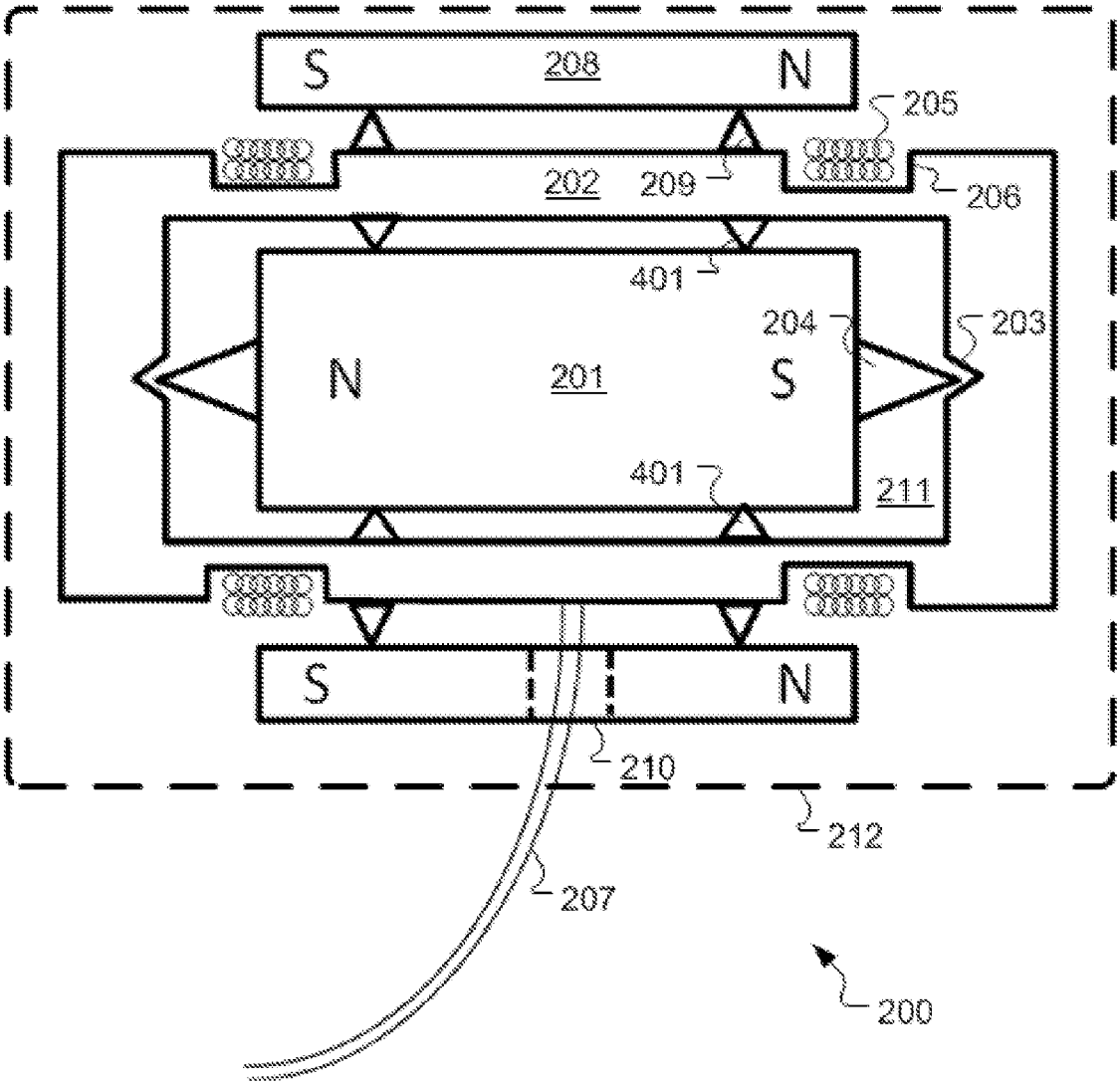
FIG. 4 shows a cross sectional view of an implantable floating mass transducer according to another embodiment of the present invention.

It is important that the inner mass magnet 201 be able to move along the longitudinal cylindrical axis with very low friction for efficient transfer of vibrational energy. However, the magnetic attraction between the inner mass magnet 201 and the outer offset magnet 208 can generate torque on the inner mass magnet 201 that in turn increases the friction with longitudinal movement. It may therefore be advantageous in some embodiments to include one or more anti-torque springs 401 as shown in FIG. 4, located between the cylindrical outer surface of the inner mass magnet 201 and the inner wall surface of the interior volume 211 of the transducer housing 202.

Figure 5:
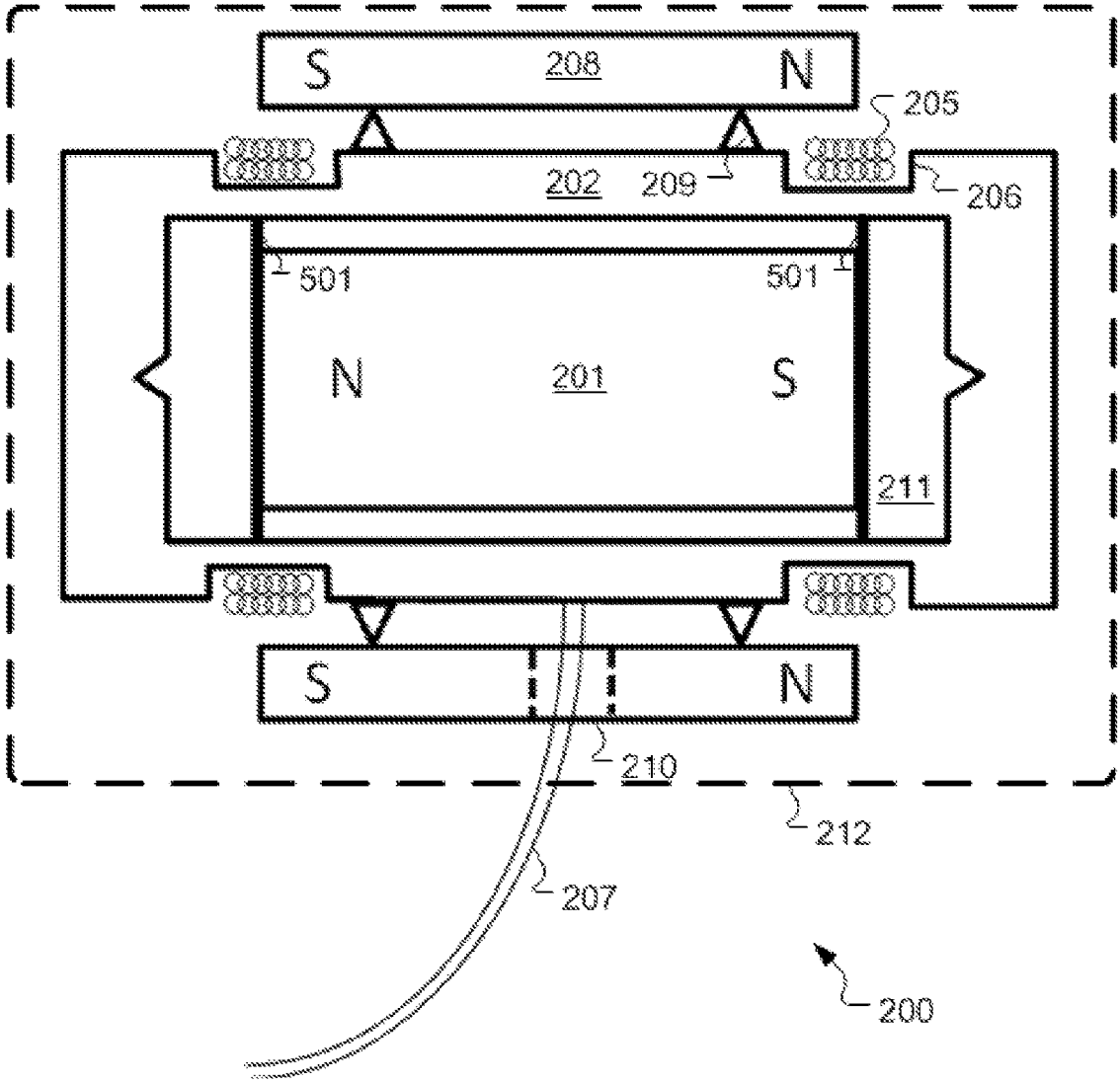
FIG. 5 shows a cross sectional view of an implantable floating mass transducer according to another embodiment of the present invention.

Alternatively or in addition, the triangular magnet springs 204 may be replaced by spring plates 501 (e.g. made of titanium) as shown in FIG. 5 that are attached at each cylindrical end of the inner mass magnet 201 within the interior volume 211 of the transducer housing 202. may be provided. They may have the advantage that the magnet within the FMT is always in a fixed and well defined position relative to the housing and the OSC magnet.

Figure 6:
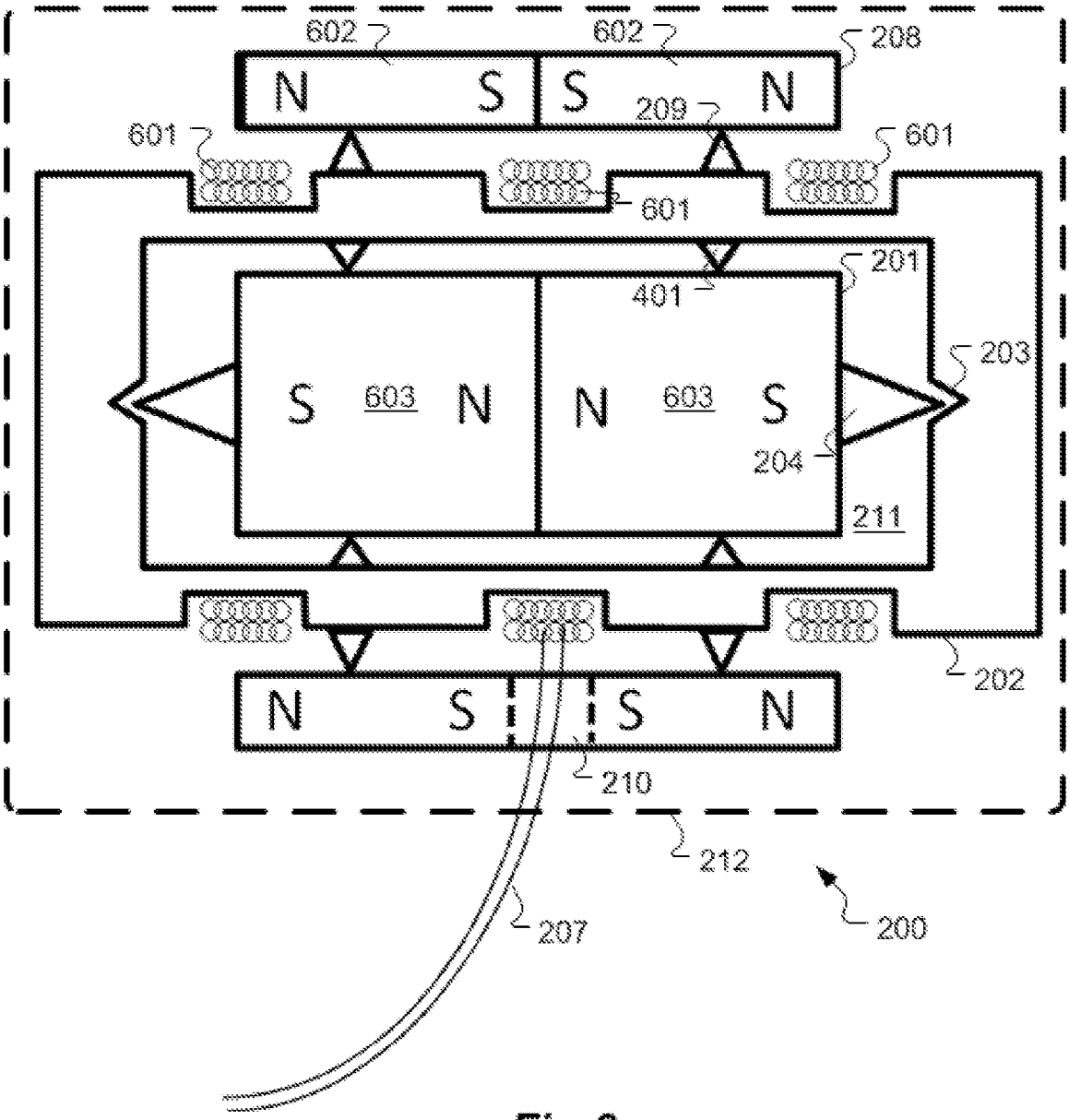
FIG. 6 shows a cross sectional view of an implantable floating mass transducer according to another embodiment of the present invention.

FIG. 6 shows a cross sectional view of an implantable floating mass transducer according to another embodiment of the present invention with a more complicated arrangement of magnets and drive coils. The inner part of the transducer 200 is like that shown in FIG. 6A of U.S. Patent Publication 2012/0219166. In such an embodiment, the inner mass magnet 201 is formed of two adjacent cylindrical magnets 603 with opposing magnetic field directions. Similarly, the outer offset magnet 208 comprises two adjacent ring magnets 602 with opposing magnetic fields which also are opposite to the magnetic fields directions of the inner cylindrical magnets 603 as shown in FIG. 6. And there are three drive coils 601 on the outer surface of the transducer housing 202 aligned with the magnetic poles of the adjacent cylindrical magnets 603 and the outer ring magnets 602. Alternatively, an embodiment might have only a single drive coil located at the middle position.

The entire transducer 200 may be covered by an outer transducer cover layer (e.g. made of titanium and/or silicone) which should provide a hermetically sealed feed-through for the electrode lead 207. Alternatively, the outer offset magnet 208 may be enclosed in a housing (e.g. titanium) that is securely connected to the transducer housing 208.

One significant advantage of such transducer arrangements is the compatibility and safety with regards to MRI examination. In addition, the implantable transducer provides a larger vibrating inertial mass that are appropriate to drive more massive anatomical (e.g. skull) and/or artificial (CI electrode lead) structures. And since the new offset magnet fits around a conventional FMT, an existing implantable transducer may retrofit and upgraded by the addition of an outer offset magnet to make an MRI-compatible transducer arrangement.

Although various exemplary embodiments of the invention have been disclosed, it should be apparent to those skilled in the art that various changes and modifications can be made which will achieve some of the advantages of the invention without departing from the true scope of the invention. For example, although embodiments are described in the specific context of middle ear implant systems, the principles of the invention are equally relevant to other types of hearing implant systems such as bone conduction implant systems.

What is claimed is:

1. An implantable floating mass transducer of a hearing implant system for an implant patient, the transducer comprising:

a cylindrical transducer housing attachable to an internal hearing structure and having an outer housing surface;

a cylindrical inner mass magnet within an interior volume of the transducer housing having an inner magnetic field with a first field direction;

at least one signal drive coil on the outer housing surface for conducting a transducer drive signal current to produce a signal magnetic field that interacts with the inner magnetic field to create vibration of the inner mass magnet which is coupled by the transducer housing to the internal hearing structure for sound perception by the implant patient;

a ring-shape outer offset magnet around the outer housing surface and having an outer magnetic field with a second field direction opposite to the first field direction to offset the inner magnetic field to minimize their combined magnetic field and thereby minimize magnetic interaction of the transducer with any external magnetic field;

a plurality of outer springs located between the outer housing surface and the outer offset magnet configured to suspend the outer offset magnet over the outer housing surface; and a plurality of inner anti-torque springs located within the interior volume of the transducer housing between an inner housing surface that is parallel to the outer housing surface and the inner mass magnet configured to suspend the inner mass magnet within the interior volume of the transducer housing.

2. A transducer according to claim 1, further comprising:

an inner magnet spring connected to each cylindrical end of the inner mass magnet suspending the inner mass magnet within the interior volume of the transducer housing.

3. A transducer according to claim 2, wherein the inner magnet springs are spring plates.

4. A transducer according to claim 1, wherein there is at least one signal drive coil on the outer housing surface over each cylindrical end of the inner mass magnet.

5. A transducer according to claim 1, wherein the inner mass magnet comprises a pair of cylindrical magnets of opposite magnetic polarity positioned end to end.

6. A transducer according to claim 5, wherein the outer offset magnet comprises a pair of ring magnets of opposite magnetic polarity positioned end to end, and each ring magnet surrounding the outer surface of the transducer housing.

7. A transducer according to claim 1, further comprising:

an outer transducer cover around the outside of the transducer.

8. A transducer according to claim 1, wherein the hearing implant system is a middle ear implant system.

9. A transducer according to claim 1, wherein the hearing implant system is a round window implant system.

10. A transducer according to claim 1, wherein the hearing implant system is a bone conduction implant system.

* * * * *